United States Patent [19]

Schimko

[11] Patent Number: 4,467,624

[45] Date of Patent: Aug. 28, 1984

[54] FLAT KNITTING MACHINE WITH SPOOL SHELF

[75] Inventor: Reinhold Schimko, Aalen-Wasseralfingen, Fed. Rep. of Germany

[73] Assignee: Universal Mashinenfabrik, Dr. Rudolf Schieber GmbH & Co. KG, Westhausen, Fed. Rep. of Germany

[21] Appl. No.: 554,404

[22] Filed: Nov. 22, 1983

[51] Int. Cl.[3] ..... D04B 3/06; D04B 15/48; D04B 27/10; D04B 35/00

[52] U.S. Cl. ..... 66/125 R; 66/60 R; 66/64; 66/126 R

[58] Field of Search ..... 66/125 R, 126 R, 64 R, 66/60 R

[56] References Cited

U.S. PATENT DOCUMENTS

| | | | |
|---|---|---|---|
| 284,905 | 9/1883 | Salisbury | 66/64 X |
| 2,705,408 | 3/1955 | Mehnert | 66/64 |
| 3,962,890 | 6/1976 | Krause | 66/125 R |
| 4,003,223 | 1/1977 | Vossen | 66/125 R |
| 4,118,955 | 10/1978 | Schieber et al. | 66/125 R |
| 4,364,246 | 12/1982 | Leins et al. | 66/125 R |

*Primary Examiner*—Ronald Feldbaum
*Assistant Examiner*—Mary A. Ellis
*Attorney, Agent, or Firm*—Sughrue, Mion, Zinn, Macpeak & Seas

[57] ABSTRACT

A flat knitting machine has a spool shelf arranged above and behind the needle bed or beds and carriage, the shelf carrying yarn spools and a yarn guide mechanism. In order to make the yarn spools and yarn guide mechanism more easily accessible, the spool shelf is arranged to be displaceable without skewing from a rearward position to a forward position, wherein in the forward position the shelf overlies at least a part of the needle bed or beds and of the carriage.

7 Claims, 4 Drawing Figures

FLAT KNITTING MACHINE WITH SPOOL SHELF

FIELD OF THE INVENTION

This invention relates to a flat knitting machine which includes a spool shelf for carrying yarn spools and yarn guide mechanism and arranged above and behind the needle bed or beds and carriage of the machine.

DESCRIPTION OF THE PRIOR ART

In known flat knitting machines of this type the spool shelf which carries the yarn spools and the yarn guide mechanism is fixed rigidly behind the needle bed or bed and the carriage, i.e. to the rear of the machine bead and above the drive mechanism. Since flat knitting machines as a rule are arranged either to back up against a wall or back to back, the tying of the yarn, the exchange of spools and also the threading of the yarn in the yarn guide elements when using the machine with the user standing in front of it can only be accomplished with difficulty because of the poor accessibility to these components when one has a rigidly fixed spool shelf.

SUMMARY OF THE INVENTION

It is an object of the present invention to improve the accessibility and consequently the handling of the components arranged on the spool shelf, and simultaneously to achieve an improved masking, in use, of the moving parts of the flat knitting machine.

This is achieved in accordance with the present invention by a combination of the following features:

(a) the spool shelf is mounted to be movable without skewing from a rearward position to a forward position, wherein in the forward position the shelf overlies at least a part of the needle bed or beds and of the carriage, (b) a cover strip is provided at the forward edge of the shelf extending lengthwise of the machine, and (c) a flap is pivotably mounted on the machine which, in combination with the cover strip, defines a cover for the needle bed or beds and carriage.

With this arrangement the handling of the components on the spool shelf when the shelf is in its forward position poses no problem and is possible in a simple manner, while the spool shelf, in the forward position, into which it is brought during the operation of the machine, at the same time completely masks off the needle bed or beds and the carriage by means of the cover strip and the flap. In the rearward position of the shelf the operator has a good field of view of and good working access to the rear carriage jaw or limb.

Preferably, the spool is arranged to be movable forwards approximately up to the centre of the needle bed or beds and of the carriage.

Furthermore, switch means are preferably provided for interrupting the electrical supply to the machine when the spool shelf is displaced rearwards and/or the flap is pivoted out of its closed position, so that the machine is brought to standstill or cannot be switched on if the spool shelf is pushed back and/or the flap is pivoted out of position.

In a preferred embodiment of the invention the spool shelf is displaceable on guide runners in the manner of a drawer, with the runners being connected to a frame of the flat knitting machine. In order reliably to prevent any skewing of the shelf during its displacement it is desirable to provide support means which carry the spool shelf above the machine frame, rack means extending transversely to the longitudinal direction of the machine, a shaft mounted on the shelf, and pinion means engaging with the rack means and carried by the shaft.

In a preferred embodiment of the invention two guide runners, two racks and two pinions are provided, one of each at each end of the spool shelf.

DESCRIPTION OF THE DRAWINGS

In order that the invention may be fully understood a preferred embodiment of flat knitting machine in accordance with the invention will now be described by way of example and with reference to the accompanying drawings, in which.

DESCRIPTION OF THE PREFERRED EMBODIMENT

Figure 1:
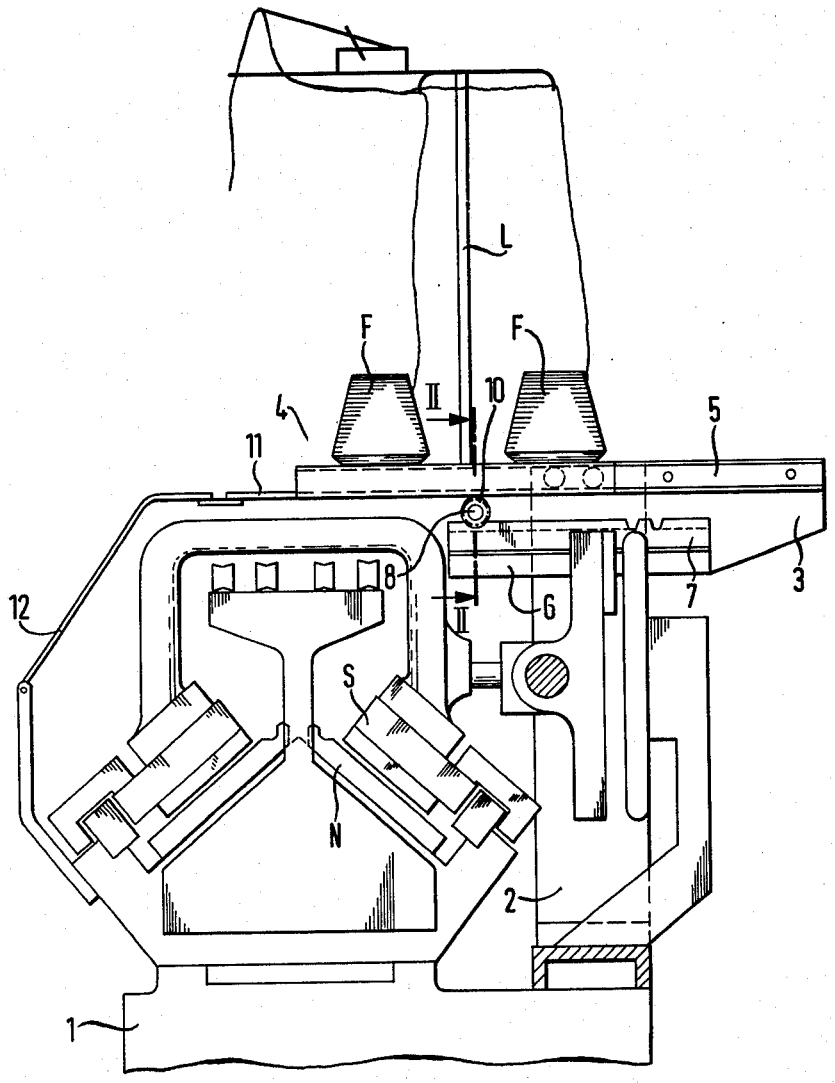
FIG. 1 is a schematic side or end view of a flat knitting machine, in which the spool shelf is in its forward position, in which position the machine can be set into operation.
Figure 2:
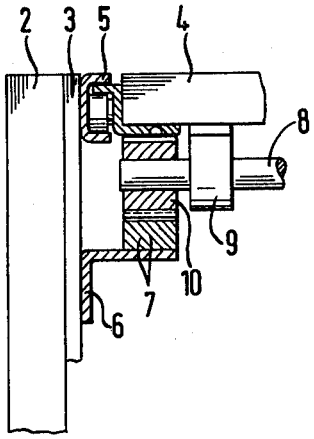
FIG. 2 is a sectional view through the flat knitting machine, taken along the line II—II in FIG. 1.
Figure 3:
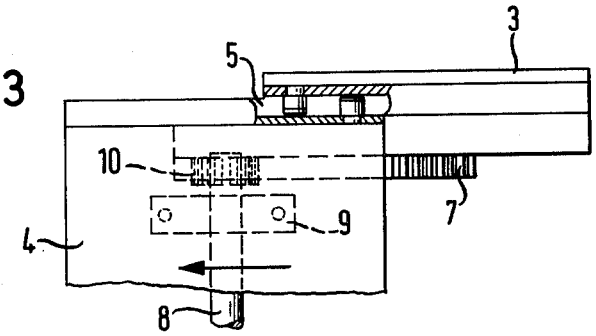
FIG. 3 is a top plan view of a part of the machine, with the spool shelf shown in its forward position.
Figure 4:
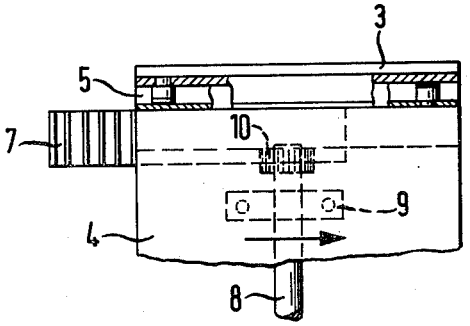
FIG. 4 is a partial top plan view, similar to FIG. 3, but with the spool shelf here shown in its rearward position after having been pushed back.

In the case of the flat knitting machine which is shown schematically in the drawings the spool shelf, which in previous machines has been rigidly fixed, is here arranged to be displaceable. At the left-hand end and right-hand end of the machine frame 1 is fixed a support post 2, and on each of these posts is fastened a supporting plate 3. A spool shelf is indicated at 4, and between the supporting plate 3 and the displaceable spool shelf 4 at each end of the machine there is fitted a guide runner 5, similar to a runner for a sliding drawer. The two guide runners 5 make it possible to displace the spool shelf 4 forwards and backwards with yarn spools F and a yarn guide mechanism L carried on the shelf.

Since the ratio of the length to the width of the spool shelf 4 is relatively large, it would normally only be possible to effect a trouble-free displacement of the spool shelf 4 with accurately centered pushing or pulling of the shelf. If the shelf is pushed or pulled at a point which is laterally offset from the centre of the shelf then there is the danger of the shelf skewing and thus becoming jammed. For this reason angle pieces 6 are fitted to the left-hand and right-hand supporting plates 3, and toothed racks 7 extending parallel to the direction of movement of the spool shelf 4 are secured one to each of these angle pieces. Below the spool shelf 4, and extending along the length of the shelf centrally of the width of the shelf, there is mounted a continuous rod 8 which is suspended in bearings 9 and which is fitted at each end with a toothed wheel or pinion 10. The two pinions 10 mesh with the corresponding toothed racks 7. By means of this mechanism one ensures an accurately parallel displacement of the spool shelf 4, even if the spool shelf, when displaced, is pushed or pulled from an off-centre position.

The spool shelf 4 is so arranged that in its forward position it lies with its front edge for example centered with respect to the machine and accurately above the carriage handle, whereas in its rearward position the shelf gives the operator a good field of view of and freedom of access to the rear jaw or limb of the carriage. In the forward position the yarn spools F and the thread guide elements of the thread guide mechanism L are easily accessible without any difficulty for the threading up of the yarn. Furthermore, a cover strip 11, for example of acrylic glass, is fitted to the spool shelf 4 along its front edge and extending lengthwise of the flat knitting machine. A pivotable flap 12, also fitted to extend lengthwise of the flat knitting machine, is provided on the machine frame and, together with the cover strip 11 on the shelf 4, serves as a protective guard or mask which prevents the machine head becoming dirty and also results in a reduction in the noise level during the traverse of the carriage.

Additionally, although not shown in the drawings, switches are provided on the flat knitting machine which are connected into the electrical supply to the machine and which function so that the electrical supply circuit is broken when the spool shelf 4 is pushed back or if the flap 12 has been or is pivoted down. In this condition the machine remains stationary and the machine cannot be switched on.

I claim:

1. A flat knitting machine comprising an elongated spool shelf arranged to carry yarn spools and yarn guide means and positioned parallel above and to the rear of the needle bed or beds and carriage of the machine, wherein:

(a) the spool shelf is mounted to be movable in a direction orthagonal to said needle bed or needle beds without skewing from a rearward position to a forward position, wherein in the forward position the shelf overlies at least a part of the needle bed or beds and of the carriage, (b) a cover strip is provided at the forward edge of the shelf extending lengthwise of the machine, and (c) a flap is pivotably mounted on the machine which, in combination with the cover strip, defines a cover for the needle bed or beds and carriage.

2. A flat knitting machine as claimed in claim 1, in which the spool shelf is displaceable forwards approximately up to the centre of the needle bed or beds and carriage.

3. A flat knitting machine as claimed in claim 1, which includes guide runners which are connected to a frame of the machine, and on which the spool shelf is displaceable.

4. A flat knitting machine as claimed in claim 3, which includes support means which carry the spool shelf above the machine frame, rack means extending transversely to the longitudinal axis of the machine, shaft means mounted on the shelf, and pinion means secured to the shaft and in engagement with the rack means.

5. A flat knitting machine as claimed in claim 4, which includes two guide runners, two rack means and two pinion means arranged with one of each at each end of the spool shelf.

6. A flat knitting machine as claimed in claim 1 which includes switch means for interrupting the electrical power supply to the machine when the shelf is displaced rearwardly and/or the flap is pivoted out of its closed position.

* * * * *

UNITED STATES PATENT AND TRADEMARK OFFICE

CERTIFICATE OF CORRECTION

PATENT NO. : 4,467,624

DATED : August 28, 1984

INVENTOR(S) : Reinhold SCHIMKO

It is certified that error appears in the above-identified patent and that said Letters Patent is hereby corrected as shown below:

On the title page the following should be added:

-- [30] Foreign Application Priority Data

November 23, 1982 [DE] Fed. Rep. of Germany.....
32 43 315 --.

Signed and Sealed this

*Thirtieth* Day of *April 1985*

[SEAL]

*Attest:*

DONALD J. QUIGG

*Attesting Officer* *Acting Commissioner of Patents and Trademarks*